United States Patent [19]

Caldwell

[11] Patent Number: 4,904,576

[45] Date of Patent: Feb. 27, 1990

[54] PHOTOSENSITIVE CUPROUS HALIDE MATERIALS AND METHODS FOR THEIR PREPARATION

[75] Inventor: Ray S. Caldwell, Denver, Colo.

[73] Assignee: Action Exploration Services, Denver, Colo.

[21] Appl. No.: 170,289

[22] Filed: Mar. 18, 1988

Related U.S. Application Data

[63] Continuation-in-part of Ser. No. 80,640, Jul. 31, 1987.

[51] Int. Cl.[4] ..... G03C 1/72; G03C 5/24

[52] U.S. Cl. ..... 430/495; 430/17; 430/434; 430/435; 430/485; 430/490

[58] Field of Search ..... 430/495, 434, 435, 433, 430/490, 485, 17; 204/94

[56] References Cited

U.S. PATENT DOCUMENTS

| | | | |
|---|---|---|---|
| 1,602,595 | 10/1926 | Sheppard et al. | 204/94 |
| 3,671,249 | 6/1972 | Flynn | 96/88 |
| 3,902,180 | 8/1975 | Sobajima et al. | 430/495 |
| 4,102,759 | 7/1978 | Gerber et al. | 204/94 |
| 4,133,933 | 1/1979 | Sekine et al. | 430/56 |
| 4,350,758 | 9/1982 | Koitabashi | 430/567 |
| 4,427,762 | 1/1984 | Takahashi | 430/436 |
| 4,433,049 | 2/1984 | Itoh | 430/495 |
| 4,582,579 | 4/1986 | Pastor | 204/94 |

FOREIGN PATENT DOCUMENTS

| | | | |
|---|---|---|---|
| 119236 | 9/1977 | Japan | 430/434 |
| 105144 | 5/1987 | Japan | 430/490 |

OTHER PUBLICATIONS

Kosar, Light-Sensitive Systems: Chemistry and Application of Non-Silver Halide Photographic Process, J. Wiley and Sons (N.Y.)-1965, pp. 14–41.

*Research Disclosure* Nos. 15166, 15252; 12/76.

*Primary Examiner*—Roland E. Martin

*Assistant Examiner*—Lee C. Wright

*Attorney, Agent, or Firm*—Jones, Tullar & Cooper

[57] ABSTRACT

Photosensitive cuprous halide-type materials, particularly cuprous chloride and cuprous bromide materials, can be prepared from an anode product material produced from electrolysis of copper in an aqueous acid halide bath. Preferably, the copper electrolysis is carried out in a dilute hydrochloric acid solution. The resulting anode product materials are particularly sensitive in the presence of a polar molecule catalyst such as water or ammonia. In one highly preferred embodiment of this invention the anode product material is treated with the aqueous solution of ammonium salt of a water soluble organic acid (e.g. aqueous solution of ammonium ascorbate); one of the chief advantages of these materials is that they are highly photosensitive when dry and can be developed from a latent image prepared thereon.

26 Claims, No Drawings

PHOTOSENSITIVE CUPROUS HALIDE MATERIALS AND METHODS FOR THEIR PREPARATION

CROSS REFERENCE TO RELATED APPLICATION

This is a continuation-in-part of copending application U.S. Ser. No. 080,640, filed July 31, 1987.

FIELD OF THE INVENTION

This invention relates to the preparation and utilization of photosensitive compositions, materials and articles whose photosensitive component is a cuprous compound which when treated to impart photosensitivity thereto as described herein darkens upon exposure to visible light. Use of such photosensitive cuprous compounds includes a host of applications including: replacement of silver in photographic emulsions; direct printing inks; touch-ups in weak printout areas of tracings; photoresists for use in the manufacture of printed circuits, for example; production of stencil transfers for glass and other carriers; manufacture of blueprints; production of papers for photoduplicators; preparation of copper images; and production of photographic emulsions which can be particularly sensitized for the detection of infrared light radiation; among others.

BACKGROUND OF THE INVENTION

Most prior art photographic methods requiring high sensitivity rely largely on the use of silver halide photographic emulsions. Such silver halide photographic emulsions are generally characterized not only by their high sensitivity, but by their high quality images and speedy reactions; however, these emulsions require a considerable amount of silver for the image production or, in the case of color photographic systems, for the intermediate medium for the formation of color images.

Photographic methods based upon the use of silver halides usually do not provide a means for recovery or reuse of the silver component, making these methods rather expensive, especially in recent times which have been characterized by dramatic increases in silver prices. Hence, it would be highly desirable if alternative photographic methods were available therein the use of silver is minimal or, better still, eliminated, while maintaining, or even improving upon, the image quality produced by silver based photographic methods. To this end, many substitutes for silver based photographic materials have been tried, for it is well known that many other metallic salts are photosensitive. In particular, copper has been the subject of great deal of research aimed at replacing silver in various photographic systems. However, to date, research in this area has failed to produce copper compounds having photosensitive properties which even marginally approach those of silver. For example, most prior art copper salt systems have generally failed to provide sharp, fog free, continuous tone, stable images.

Of all the copper salts which have been investigated, cuprous halide compounds probably have been the subject of the most intense study. Some representative examples of the results of this research include:

1. U.S. Pat. No 4,350,758, which is typical of a number of references, teaches the use of a mixture of silver halide and copper halide (e.g. CuCl) salts to prepare photosensitive emulsions. The copper halide is formed by conventional chemical precipitation methods which do not include the electrolytic deposition of a sensitive copper materials as described in the present invention.

2. U.S. Pat. No. 4,427,762 describes a photosensitive copper (I) halide (optionally mixed with silver halide) in a binder which can be exposed and developed with an alkaline developer (e.g. a mixture of an amine and an ascorbic acid derivative). Formation of a copper (11) complex is disclosed. Here again, the cuprous halide is formed by chemical precipitation reactions which do not include copper electrolysis.
3. U.S. Pat. No. 4,433,049 teaches utilization of an ascorbic acid halide derivative (similar to that disclosed in U.S. Pat. No. 4,427,762) to reduce cupric ions in a liquid phase to form photosensitive cuprous halides. There is no disclosure of a photosensitive material obtained by electrolysis.
4. U.S. Pat. No. 3,671,249 teaches a process for preparing a photosensitive cuprous nitrate composition by reacting cuprous halide (e.g. CuCl) with silver nitrate to provide a mixture of cuprous nitrate and silver halide. The material of the present invention, on the other hand, is produced by electrolysis, and is not a mixture of materials as described in this reference.
5. Kosar, Light-Sensitive Systems: Chemistry and Application of Non-Silver Halide Photographic Processes, J. Wiley and Sons (NY)—1965, pp. 14–41, teaches the photosensitive nature of CuCl and how this material can be made into photosensitive films through the use of various binders and the like. The use of OuOl obtained by copper electrolysis is not taught or suggested by this reference.

In all of the aforementioned documents, the products obtained do not produce the results obtainable with the present invention; that is, sharp, fog free, continuous tone, stable images in silver-free systems.

SUMMARY OF THE INVENTION

It is an object of the present invention to provide a novel imaging system based on photosensitive copper compounds. It is a further object of the invention to provide a novel process for the manufacture of photosensitive copper materials. A still further object is to provide a photosensitive copper element which can be sensitized and developed from a latent image placed thereon.

These and still further objects are achieved by providing a photosensitive element comprising a support, or substrate, having coated thereon at least one photosensitive layer comprised of the anode product of a copper-containing material produced by the electrolysis of copper in an aqueous acid halide bath, the anode product having been treated to impart photosensitivity thereto prior to exposure thereof to a light pattern.

More particularly, the present invention relates to a method of producing a copper-containing photosensitive material, coating the material on a support or substrate, sensitizing the material so that it responds to a light pattern exposure to form a latent image, developing the image, and fixing to produce a permanent, visible image of the exposed pattern. The photosensitive material is produced as the anode product of a copper electrolysis process in which a copper anode is placed in an aqueous acid halide bath. When this cuprous halide anode product is in contact with a polar substance such as water, ammonia, or the fumes of hydrofluoric acid, it is highly sensitive to light, and will rapidly change color upon exposure to light of any color in the visible spectrum.

The anode product may be coated on a substrate, such as paper, and while in contact with a polar substance, it will remain sensitive to light. When dry, the coating loses its sensitivity, but this can be restored by again contacting the surface of the coating with a polar substance. The sensitized coating paper provides a photosensitive element which can be exposed to a light pattern to produce a latent image, i.e. an image which, if not developed and fixed, will dissipate as the element dries.

The cuprous halide anode product can be sensitized and stabilized so that it retains its photosensitivity even when it is dry. In particular, the dried anode product coating can be sensitized and the sensitivity made permanent or the sensitivity of a wet coating can be made permanent by treatment with an aqueous solution of an ammonium salt of a water soluble organic acid such as citric or ascorbic acid and then drying. When thus stabilized, the element can be exposed to a light pattern to produce a permanent latent image which will remain even when the element is dry.

The latent image produced on the photosensitive element can be developed to make it visible by placing the element in a bath of developing fluid, such as a solution of citric or tartaric acid and sodium bicarbonate balanced to an optimum pH. In the development reaction, those image areas which have been exposed to light turn gray to black, depending on the light intensity. Unexposed areas turn from white to various tones of yellow.

After removal of the element from the development solution, the image will fade unless it is quickly dried. This can be accomplished by immersing the element in denatured alcohol and drying it in warm air. Alternatively, the image can be fixed by immersing it in a very dilute acid, such as very dilute hydrochloric acid or in very dilute sodium thiosulfate, followed by rinsing in water and drying in denatured alcohol.

DETAILED DESCRIPTION OF THE INVENTION

In its simplest form, the objects of the present invention can be achieved through a process of copper electrolysis employing a pair of electrodes including a copper anode in an aqueous acid halide electrolyte solution or bath, applying a current through the electrodes, and collecting the anode product therefrom. Among the various cuprous halide materials which can be employed in the practice of this invention cuprous chloride and cuprous bromide materials are highly preferred. The resulting anode product alone, when coated on a conventional support and contacted with a polar substance (e.g. water, ammonia or hydrofluoric acid), is highly light sensitive and will produce an excellent image when exposed to light. This is, in and of itself, surprising since the anode product appears to be mainly cuprous halide, and these halides had previously been considered to be not particularly photosensitive alone. Moreover, it has been discovered that even better properties may be achieved by following preferred processes as taught below. Thus, not only is a photosensitive copper material produced but methods for sensitizing the material and making the sensitivity permanent for producing a permanent high resolution image from a latent image applied to a photosensitive layer of the material of this invention have been discovered.

Hence, the anode product materials produced and treated as disclosed herein can be used in various compositions which may be employed in a wide variety of photoresponsive processes such as those listed above. Furthermore, photographic films or emulsions produced from cuprous halide anode product materials produced and treated as disclosed herein are capable of producing clear, fog free images of black copper based materials on a wide variety of substrates used in the photographic arts; e.g., photographic papers, polyvinyl chloride films and the like.

The production of the photosensitive cuprous halide materials of this invention begins with the collection of the anode product of an electrolysis of copper. As is well known, electrolysis can be carried out over a wide range of electrical potentials and currents. For example, a 12 volt, 6 ampere bath system produces a material which is virtually the same as that produced by an otherwise analogous 36 volt, 18 ampere system. The copper source comprises the copper anode used in the electrolysis bath cell system. The halide source preferably is a halide ion source such as that provided by acids capable of producing halide ions. The electrolysis is most preferably carried out in a halide bath system provided by a dilute solution of hydrochloric or hydrobromic acid. The anode product material produced by this electrolysis includes cuprous chloride in the case of a copper electrolysis conducted in a hydrochloric acid bath system, cuprous bromide in the case of a copper electrolysis conducted in a hydrobromic acid bath, and so forth. If desired, the photosensitive anode products of the present invention can be co-prepared from combined halide ion sources such as hydrochloric acid and hydrobromic acid. The anode product material need not be, and preferably will not be "pure" cuprous chloride, "pure" cuprous bromide etc., but rather should be a mixture of cuprous halide and other materials and/or a more complex molecule, having other attributes such as those associated with cuprous oxyhalides. The same is also true of any other cuprous halide products which can be employed, e.g., cuprous chlorobromide, cuprous iodobromide, cuprous chloroiodobromide, etc. anode product materials.

For example, a typical cuprous chloride material prepared by the electrolysis of copper is not "pure" cuprous chloride, but rather contains, by weight, 60.18% copper, 33.18% chlorine, 4.88% oxygen, and 1.13% hydrogen. The resulting cuprous chloride anode product material is formed as particles having a maximum dimension which is only about 1/20 of the maximum dimension of cuprous chloride crystals produced by conventional precipitation methods. Accordingly, the maximum dimension of cuprous chloride anode product material as well as other cuprous halide anode product materials produced by an electrolysis of copper in accordance with the present invention typically will have a maximum dimension of about one micron.

The cuprous halide anode product materials produced as described above are photosensitive, i.e., they react to light by changing color, in the presence of water, or other polar substances, but are not photosensitive when they are dry. When wet, they turn from pure white to shades of gray, to deep black, in direct relation to light intensity and time of exposure, but as they dry, they revert back to the original white; thus, the anode product materials are unstable. However, it has been found that they can be treated to be stable, as described in detail hereafter. The photosensitive copper anode products of this invention; i.e., cuprous halide materials produced as the anode product of copper electrolysis, have superior photoresponsive qualities compared to those cuprous halides produced by other chemical formulation or precipitation methods. In some respects, such as contrast properties, the photosensitive qualities of the materials of this invention are even superior to those of silver halide systems. For example, they sharply turn from white to gray to black depending on light intensity, while silver chloride, for example, responds in shades of blue and purple under similar conditions.

The superior photosensitive qualities of the disclosed copper electrolysis anode product materials over copper halides produced by other chemical methods can be maintained and/or enhanced by certain hereinafter disclosed additional processes (e.g. permanent sensitization and development/fixing of the image) which form other aspects of this invention.

As previously indicated, it has been found that the photosensitivity of the anode product materials requires the presence of certain polar materials such as water, ammonia and hydrofluoric acid. Thus, the anode product material is initially photosensitive when it is manufactured in the electrolysis process, since the electrolyte bath normally includes a polar substance such as water. In use, however, any one or more of the anode product materials is typically spread in a thin layer on a support such as a sheet of paper, a film, or other conventional substrate, and is dried, at which point the anode product material loses its sensitivity to light. Thereafter, the anode product layer can be sensitized to light by contact with any of the aforementioned polar substances, and the layer will respond to light, i.e., will be photosensitive, and will remain so until it dries again. Sensitization by ammonia is most conveniently provided by contact of the cuprous halide anode product materials to ammonium hydroxide fumes at ambient temperatures. Sensitization with water is readily carried out, for example, by contacting in any convenient way, for example, spraying or dipping. Sensitization with hydrofluoric acid is readily carried out by exposure to fumes thereof.

An image produced by exposing a layer of anode product material to light in the presence of one of the polar substances particularly described above fades when the polar material dissipates, for when the layer dries, the halide materials revert to their original white color.

In accordance with a further feature of the present invention, photographic images produced by light reactions of cuprous halide materials in contact with polar substances such as those described above can be stabilized; i.e., made permanent, by treatment of the halide material before exposure, with aqueous solutions of ammonium salts of water soluble organic acids (e.g., citric, ascorbic acids) In one highly preferred embodiment of this invention, the cuprous halide anode product material is stabilized by contact with an aqueous ammonia ascorbic acid solution, is spread in a thin layer on a support, and then dried. The resulting photosensitive element is both light sensitive and stable, so that it is capable of retaining a developed image or a latent (undeveloped) image indefinitely.

Print-out images have been produced which employ the anode product material of this invention along with the sensitizing processes described, through exposure to direct sunlight for less than three seconds. High resolution images have been obtained with maximum contrast images being produced in less than about ten seconds. The resulting images are gray to black on a white background.

Another highly desirable attribute of the sensitized cuprous halide anode product material herein is that a latent image can be directly and fully developed by placement of the exposed material in solutions of citric or tartaric acid and sodium bicarbonate which have been balanced to an optimum pH of between bout 8.4 and 7.6 and most preferably at a pH to about 8. In the development reaction, the areas exposed to light turn gray to black depending on light intensity. The unexposed areas turn from white to various tones of yellow. The development reaction is fast; complete development, without fog, is obtained in about 15 seconds. However, after removal from the developing solution, the image will fade unless it is quickly dried. This quick drying can be accomplished, for example, by immersing the element in denatured alcohol and then drying in warm (e.g. 125° F.) air. Any yellow tones of the developed image are corrected to pure white-gray-black by immersing in a very dilute acid such as very dilute hydrochloric acid, followed by rinsing in plain water and drying in denatured alcohol. A preferred method for fixing or stabilizing this image is immersing the exposed and developed image in very dilute sodium thiosulfate (e.g. a 5–10%) solution.

A particularly preferred photosensitive element is prepared by the unique processes of this invention, and incorporates a support having a photosensitive layer coated thereon, the photosensitive layer comprising the anode product of a copper containing material produced by the electrolysis of copper in an aqueous acid halide bath, the layer being sensitized and stabilized with a sensitizing amount of ammonium ascorbate solution which is applied together with a polyvinyl alcohol binder and dried. This element remains photosensitive indefinitely, and can be exposed to light to prepare a latent image. The latent image is developed by contacting the image with a sodium citrate solution, and this is followed by fixing the image by immersing the element in dilute sodium thiosulfate. The photosensitive element is formed by coating the foregoing materials on anV of the conventional supports used bV the prior art such as glass, paper, or polyethylene terephthalate, among many others. Although polyvinyl alcohol is a preferred binder, others, well known to those of reasonable skill in the art, can be employed within this invention. For example, the polyvinyl alcohol can be replaced with gum arabic. Ammonium ascorbate is particularly preferred as the sensitizing solution, although ammonium citrate and other water soluble ammonium salts of organic acids can also be employed.

The invention herein is illustrated by the following specific examples:

EXAMPLE I

Preparation of Cuprous Halide Anode Product

Cuprous halide material in an optimum grain size for photographic applications was prepared in this invention by electrolysis. A 5 percent solution of hydrochloric acid was employed with a copper anode and copper cathode. The anode was a copper bar, 3 inches wide by ½ inch thick. The cell used contained 4 liters of solution and employed a 12 volt direct current source. When the voltage was applied, the current very gradually increased from near zero to 6 to 8 amperes. The period of time to reach maximum current flow was about 30 minutes. A deposit of white cuprous compound began forming on the anode as a result of chlorine ions changing to chlorine atoms and reacting with the metallic copper of the anode. As the deposit on the anode grew, it flaked off, and dropped into a container placed below the anode, and was saved. As the process continued, copper ions formed in the solution and some metallic copper was deposited at the cathode as sponge. This sponge can be made to sink to the bottom of the cell and thereby prevent contamination of the anode product by the addition of about 1 gram of gelatin to the 4 liter electrolyte solution.

The product of the anode was preserved and protected from oxidation by adding water of about 8 times its volume and adding HCl to make a 1 percent solution. This was mixed to form a slurry prior to applying to a support and/or applying the sensitizing compositions as described below.

EXAMPLE II

Comparative Analysis

Comparison of the electrolysis anode product cuprous halide material of Example I with analogous products formed by conventional precipitation methods as represented by reagent grade cuprous chloride (Fisher Chemicals) produced the following results:

(A) Elemental Analysis—Weight %

| Element | Fisher CuCl | Applicant's Material |
|---|---|---|
| Cu | 64.13 | 60.18 |
| Cl | 35.86 | 33.81 |
| O | | 4.88 |
| Other | | 1.13 |

The Cu/Cl ratio of applicant's material was determined to be 1.780 vs. 1.788 theoretical, i.e., it was copper-poor by about 0.4%. A good portion of the material designated as "Other" was hydrogen; carbon was barely detected.

(B) Trace Elements—ppm—(atomic flame absorption)

| | Cu | Si | Mn | Fe | Na |
|---|---|---|---|---|---|
| Fisher CuCl | major | 87 | 1 | 15 | 94 |
| Applicant | major | 150 | 2 | 350 | 110 |

(C) Thermogravimetric Analysis

A thermogravimetric analysis was run on applicant's sample. The sample lost 1.89% of its weight between room temperature and 150° C. and was then stable up to 550° C. when weight loss occurred amounting to 75% by weight by the time 620° C. was reached. An additional 0.2% weight loss occurred when air was introduced.

(D) Surface Area

Nitrogen absorption using the BET technique gave a surface area of 0.57 sq m/g for the Fisher CuCl, and 4.00 sq m/g for applicant's material. Micrographs show applicant's material to be thin plates typically a micron or so in maximum dimension.

(E) X-Ray Powder Diffraction

The Fisher CuCl showed 3 lines. Applicant's material had the same three major lines showing it is mostly CuCl, but additional lines also appeared which might be indicative of small amounts of polycrystalline occlusions or other copper species, e.g., oxide, oxychloride, cupric, iron impurities etc.

(F) IR Spectra—in pressed KBr Wafer

Two peaks occur in the Fisher CuCl sample. The Fisher CuCl crustal structure has two types of chlorine bonds:

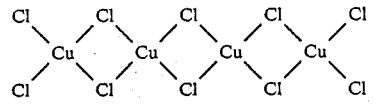

These two peaks also occur in applicant's sample, but many additional peaks appear that could be attributed to additional metal-halogen stretching frequencies, or possibly metal-oxygen. Applicant's materials also appear non-stoichiometric, polyphase and with many different components.

EXAMPLE III

Light Sensitizing the Cuprous Chloride Anode Product with Ammonia

To render the cuprous halides highly light sensitive, the following procedure was carried out: Ouprous chloride anode product slurry as formed in EXAMPLE I was applied as a thin coating (about 20 to 30 microns) to a paper surface (unsized 3×5 index cards), dried in warm air (about 125° F., from a hair dryer) and then exposed to the fumes of 14 percent ammonium hydroxide (ammonia gas) for 5–10 seconds.

EXAMPLE IV

Light Sensitizing the Cuprous Chloride Anode Product with Ammonium Citrate

A sensitizing solution was prepared by bringing anhydrous citric acid into solution with 14 percent ammonium hydroxide to a pH of approximately 3.6. This was mixed at a ratio of about 1:1 with cuprous chloride anode product slurry formed as in EXAMPLE I and applied as a thin coating (20–30 microns) to a paper surface and quickly dried. The solution was prepared, applied, and drying was carried out in a nitrogen (oxygen-free) atmosphere.

EXAMPLE V

Light Sensitizing the Cuprous Chloride Anode Product with Ammonium Ascorbate A sensitizing solution was prepared by bringing ascorbic acid into solution with 7 percent ammonium hydroxide to a pH of 4 to 5.5. This was mixed at a ratio of about 1:1 with cuprous chloride anode product slurry formed as in EXAMPLE I and applied as a thin (20–30 micron) coating to a paper surface and dried. Mixing, application and drying was carried out under nitrogen.

EXAMPLE VI

Light Sensitizing the Cuprous Chloride Anode Product with Water

Cuprous chloride anode product slurry formed as in EXAMPLE I was applied as a thin (20–80 micron) coating to a paper surface, quickly dried in warm air using a hair dryer to supply drying air at about 125° F., light sensitivity was imparted by wetting with water.

EXAMPLE VII

Light Sensitizing the Cuprous Chloride Anode Product with Hydrofluoric Acid

Cuprous chloride anode product slurry formed as in EXAMPLE I is applied as a thin (20–30 micron) coating to a paper surface, dried in warm air and then exposed to fumes of hydrofluoric acid under a hood.

EXAMPLE V

Sensitizing Results

The sensitized products of Examples IV (ammonium citrate treated) and V (ammonium ascorbate treated) retain light sensitivity permanently. The sensitized products of Examples III (ammonia treated), VI (water treated), VII (hydrofluoric acid treated) retain light sensitivity for 1–2 hours; i.e., until "dry".

EXAMPLE IX

Developing and Fixing the Sensitized Cuprous Chloride Anode Product

Samples of the elements produced in Examples III–VI were exposed to light to form a latent image on each element. Sodium citrate was used to develop the latent images. It was prepared by mixing 8 grams of anhydrous citric acid with 24 grams of sodium bicarbonate and bringing into solution with one liter of water. Development of a latent image was complete in less than 30 seconds with good contrast properties. At this point, the images were black with tones of yellow.

The images were fixed by immersing in a 2 percent solution of sodium thiosulfate for a few seconds until the yellow tones changed to gray-white. The images were then dried and became stable.

Developed images were also fixed by immersing the elements in a very dilute (1%) solution of hydrochloric acid until the yellow tones changed to gray-white and then immersing in denatured alcohol to absorb water and then drying with warm forced air. This also provided stable images in each case.

EXAMPLE X

An electrolyte solution comprising 4.5 1. of 1 M HBr with 0.6 g. of gelatin/liter, 64 ml. of 98% $H_2SO_4$ and 8 drops of trinitrobutyl phosphate was prepared. Some of this electrolyte was placed in a large, ca. 2,000 ml, bath along with two copper rod electrodes. These rods were first burnished with #624 grit emory cloth and rinsed with water prior to insertion in the aforementioned bath. A power supply was connected to both copper rods and a small beaker was positioned beneath the anode. All room lights were turned off and the power supply was set at 8 amp and the current then applied. The initial voltage was 3.2 v which slowly rose to 4v after about 1 hour. White material formed on the anode and flaked off into the beaker positioned below. After about 3 hours the current was turned off, the collecting beaker removed and the solids filtered, washed several times with 0.1N HBr and water to yield 38.6 g. of anode product. This material was transferred to a light resistant bottle and covered with about 36 g. of 0.1N HBr.

A sample of this solid was mixed with 10% aqueous polyvinyl alcohol, coated on a white unsized 3×5 index card using a small sponge. The coating was dried, contacted for 5–10 seconds with the fumes of a 20% aqueous $NH_4OH$ solution and then given an image-wise exposure through a contact glass image to bright sunlight for 10 seconds. The latent image was then developed in the following developer:

| | |
|---|---|
| Citric acid (anhydr) | 8 gm |
| Sodium Bicarbonate | 24 gm |
| Distilled water to | 1,000 ml. |
| pH = 8.0 (adjusted) | |

A good, readable image soon appeared (ca. 30 seconds to 1 min.). The image was then fixed in ca. 10% aqueous sodium thiosulfate solution whereupon the yellow background disappeared leaving a black, negative image of the original.

EXAMPLE XI

Cuprous chloride anode product was prepared according to the method described above in Example I. A small amount of this cuprous chloride anode product (ca. 0.3 g) was mixed in a beaker along with 0.2 g. of aqueous polyvinyl alcohol (ca. 10% 71–30 Elvanol®, E.I. du Pont de Nemours & Co.). Ammonium ascorbate sensitizer (ascorbic acid added to a 7% $NH_4OH$ solution to achieve pH 4–5) was then added (0.5 g.) to achieve a 50 sensitizer/30 anode product/20 polyvinyl alcohol mixture. This mixture was stirred and then some was coated on a 3×5 white card using a sponge. The coating was dried under hot air and exposed 5 seconds through a test image to a i50 W flood light at ca. 12 inches. The imaged element was then developed 3 min. in 2% trisodium citrate solution. After several seconds, a faint negative image began to appear and by the end of the developing period a high quality black image on a yellow background appeared. This image was then fixed in 2% aqueous sodium thiosulfate for 3 minutes whereupon the yellow background disappeared. The black image after rinsing in water and drying, was of archival quality. In a like manner, coatings were applied to a variety of supports (glass, polyethylene terethhalate ceramics) with equivalent results. When the supports were glass or ceramics, the non-exposed images were completely fixed indicating total removal of the coating.

The terms "aqueous solution of ammonium salt of water soluble organic acid" and "aqueous ammonia solution of water soluble organic acid" are used interchangeably herein to mean aqueous solutions containing ammonium ion and organic acid in ionized or unionized form whether formed by dissolving ammonium salts of organic acids or admixing organic acid with aqueous ammonium hydroxide solution or by any other means that would occur to a chemist. These terms include treatment in one step as well as treatment in a succession of steps, e.g., first with aqueous ammonium solution followed by treatment with aqueous organic acid solution.

Variations will be evident to those skilled in the art. Thus, the scope of the invention is intended to be defined by the claims.

What is claimed is:

1. A photosensitive element comprising:

a support;

at least one layer coated on said support, said layer comprising the copper containing anode product, produced by the electrolysis of copper in an aqueous acid halide bath; and means including a polar substance selected from the group consisting of water, ammonia and hydrofluoric acid in contact with said layer for photosensitizing said layer.

2. The element of claim 1, wherein said acid halide is hydrochloric acid.

3. The element of claim 1, wherein said polar substance is water.

4. The element of claim 1, wherein said polar substance is ammonia.

5. A photosensitive element comprising;

a support;

at least one layer comprising the copper containing anode product produced by the electrolysis of copper in an aqueous acid halide bath coated on said support; and means for photosensitizing said layer, said means comprising an aqueous solution of ammonium salt of water soluble organic acid.

6. The element of claim 5, wherein said salt is selected from the group consisting of ammonium ascorbate and ammonium citrate.

7. The element of claim 6, wherein said salt is ammonium ascorbate.

8. The element of claim 6, wherein said salt is ammonium citrate.

9. The element of claim 5 wherein said acid halide is hydrochloride acid.

10. A photosensitive element comprising a support and coated thereon at least one photosensitive layer comprising the anode product of a copper containing material produced by the electrolysis of copper in an aqueous acid halide bath, said anode product having been contacted with an aqueous ammonia solution of water soluble organic acid to impart photosensitivity thereto.

11. The element of claim 10 wherein said organic acid is ascorbic acid or citric acid.

12. The element of claim 11 wherein said acid halide is hydrochloric acid.

13. The process of preparing an image, comprising:

collecting the copper containing anode product produced by the electrolysis of copper in an aqueous acid halide bath;

applying said anode product in a thin coating to a substrate;

photosensitizing said anode product by contacting the surface of said coating with a polar substance selected from the group consisting of water, ammonia and hydrofluoric acid;

imaging said coating after photosensitizing the anode product;

developing the image carried by said coating; and fixing the image.

14. The process of claim 13, further including producing an aqueous slurry of said anode product, wherein the step of applying said anode product includes coating said aqueous slurry on said substrate.

15. The process of claim 14, wherein the step of photosensitizing includes permanently sensitizing said anode product by adding to said slurry an aqueous solution of ammonium salt of water soluble organic acid prior to applying said coating.

16. The process of preparing an image, comprising:

collecting the copper containing anode product produced by the electrolysis of copper in an aqueous acid halide bath;

applying said anode product in a thin coating to a substrate;

photosensitizing said anode produce by contacting the product with a sensitizing amount of an aqueous solution of ammonium salt of water soluble organic acid;

imaging said coating; developing the image carried by said coating; and fixing the image.

17. The process of preparing an image, comprising:

collecting the copper containing anode product produced by the electrolysis of copper in an aqueous acid halide bath;

producing an aqueous slurry of said product;

coating said aqueous slurry in a thin coating on said substrate;

drying said coating;

temporarily sensitizing said coating by applying a polar substrate selected from the group consisting of water, ammonia and hydrofluoric acid to the surface thereof;

imaging said coating;

developing the image carried by said coating; and fixing the image.

18. The process of preparing an image, comprising:

collecting the copper containing anode product produced by the electrolysis of copper in an aqueous acid halide bath;

applying said anode product in a thin coating to a substrate;

imaging said coating after photosensitizing the anode product;

developing the image carried by said coating, by contacting said coating after imaging with a solution of sodium citrate balanced to a pH of about 8; and fixing the image.

19. The process or claim 18, wherein the step of fixing includes contacting said coating after development with a very dilute acid, following by rinsing in water and drying.

20. A process for preparing a photosensitive material comprising the steps of:

(a) applying a current through a pair of electrodes including a copper anode in an aqueous acid halide bath;

(b) collecting the product generated at the anode in said bath; and (c) permanently sensitizing said product by contacting it with a sensitizing amount of an aqueous solution of ammonium salt of water soluble organic acid.

21. The process of claim 20 wherein said ammonium salt of water soluble organic acid is ammonium ascorbate.

22. The process of claim 20, wherein said ammonium salt of water soluble organic acid is ammonium citrate.

23. A process for preparing a photosensitive material comprising the steps of:

(a) applying a current through a pair of electrodes including a copper anode in an aqueous acid halide bath;

(b) collecting the product generated at the anode in said bath;
(c) coating said product on a support;
(d) drying said coating; and
(e) photosensitizing said coating by contacting the surface thereof with a polar substance selected from the group consisting of water, ammonia and hydrofluoric acid.

24. A photosensitive element comprising:
a support;
at least one layer comprising the copper containing anode product produced by the electrolysis of copper in an aqueous acid halide bath coated on said support, wherein said anode product is preserved by admixing it with water and HCl.

25. A photosensitive element comprising:
a support;
at least one layer comprising the copper containing anode product produced by the electrolysis of copper is an aqueous bath coated on said support, wherein said anode product contains by weight 60.18% Cu, 33.81% Cl and 4.88% 0.

26. A photosensitive element comprising:
a support;
at least one layer comprising the copper containing a mode product produced by the electrolysis of copper in an aqueous acid halide bath coated on said support, wherein said anode product has a Cu/Cl ratio of 1.780.

* * * * *